United States Patent [19]

Luff

[11] 4,170,451

[45] Oct. 9, 1979

[54] SKID PIPE COVERING

[75] Inventor: Donald G. Luff, Lansdale, Pa.

[73] Assignee: Combustion Engineering, Inc., Windsor, Conn.

[21] Appl. No.: 732,274

[22] Filed: Oct. 14, 1976

[51] Int. Cl.[2] ..... F27D 3/02

[52] U.S. Cl. ..... 432/234; 138/147

[58] Field of Search ..... 432/233, 234; 138/147, 138/149

[56] References Cited

U.S. PATENT DOCUMENTS

| | | | |
|---|---|---|---|
| 3,572,662 | 3/1971 | Weaver et al. | 432/234 |
| 3,781,167 | 12/1973 | Ahonen | 432/234 |
| 3,820,947 | 6/1974 | Boto et al. | 432/234 |
| 4,071,311 | 1/1978 | Errington | 138/149 |

FOREIGN PATENT DOCUMENTS

| | | | |
|---|---|---|---|
| 1342891 | 1/1974 | United Kingdom | 432/234 |

*Primary Examiner*—John J. Camby

*Attorney, Agent, or Firm*—Wayne H. Lang

[57] ABSTRACT

An arrangement by which a jacket of preformed insulating material is readily installed around the outer surface of a water cooled pipe that is to be used as a structural support or a skid rail for a heat treating furnace.

7 Claims, 3 Drawing Figures

SKID PIPE COVERING

BACKGROUND OF THE INVENTION

Field of the Invention

Water cooled pipes and skid rails are used to support heavy metal workpieces in heat treating furnaces. The skid rails lie parallel to the path of the workpieces and they extend through the furnace whereby burners positioned above and below the workpieces throw an exhaust flame upwardly between the support pipes and the skids to completely envelop the workpieces with hot exhaust gases as they are moved through the furnace. To prevent the water cooled pipes and skid rails from weakening and sagging due to the high temperature of the furnace, and to prevent the requirement of excessive cooling medium for the pipes with a lowering of the efficiency, the pipes and skids alike are covered with insulating material that is held in place by various anchoring devices.

Inasmuch as applying the insulating material to the pipes and anchoring it firmly in place can be a time-consuming and expensive operation, the insulating material is frequently prepared in preformed segments that are applied by novel anchoring devices to the outer periphery of the pipes in an attempt to save assembly time.

SUMMARY OF THE INVENTION

The present invention similarly relates to an improved arrangement for anchoring a jacket of preformed insulation material to the outer surface of a furnace support or skid pipe.

The insulating jackets of the present invention are comprised of arcuate segments of preformed insulating material that collectively enclose the pipe and are anchored thereto by the use of readily fastened metallic bands that are first locked concentrically around the pipe. The bands are adapted to be readily secured to the pipe and they include stud-like appendages that extend radially outward therefrom to traverse aligned openings in the surrounding insulating jacket whereby locking means on the outer ends of the appendages will hold the insulating jackets in position around the pipe.

DESCRIPTION OF THE PREFERRED EMBODIMENT

Figure 1:
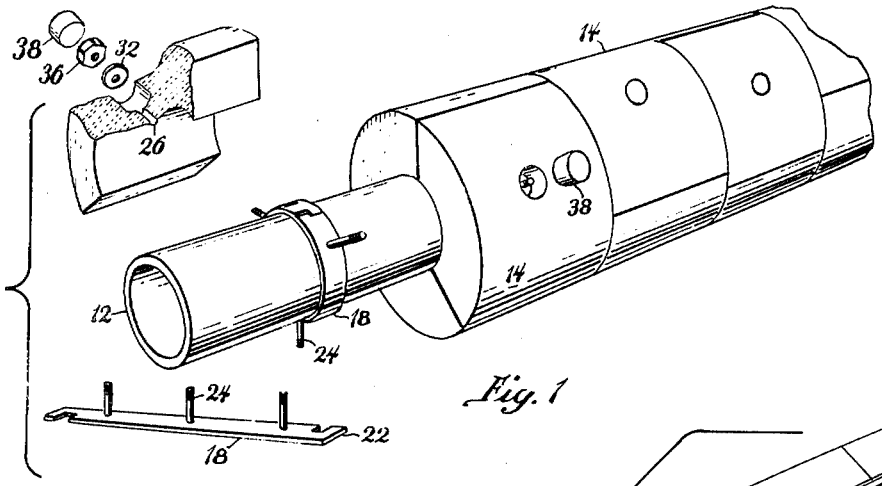
FIG. 1 is perspective view of a pipe adapted to receive a jacket of preformed insulating material in the manner defined by the invention.

Referring to FIG. 1 of the drawing, a water cooled support pipe 12 exposed to a source of external heat is provided with a jacket of preformed insulative material made in accordance with the present invention. Each jacket comprises abutting sector shaped segments 14 of insulative material that cooperate together to comprise a jacket around the pipe. The segments 14 are held on to the pipe 12 by flexible metallic bands 18 that extend around the pipes and anchor the insulative material. The flexible metallic bands are held around the pipes by a system of interlocking ends 22 that permit circumferential movement of each band.

The straps or bands 18 have attached thereto a series of equally spaced studs or threaded bolts 24 that reach perpendicularly outward through holes 26, pre-drilled radially in the insulative jacket 14. The pre-drilled holes in the insulation jacket are partially counter-bored from the outside at 28 with a somewhat larger drill that forms a shoulder 30 on which a washer type fitting 32 will comfortably lie. Then when a nut 36 is threaded on the stud 24 and drawn up against the washer, the segment of insulative material will be drawn tightly to the surface of the elongate pipe. A plug 38 of insulative material is finally inserted into the opening 28 to further isolate the stud 24 and nut 36 from the furnace heat and provide a continuously smooth surface to the enveloping gases.

Although each jacket is shown with but one band 18 and a centrally located stud 24 for each segment of the insulative jacket 14, it is obvious that additional straps or bands and their attached studs may be used for any given pipe section. The type of band, the number of projecting studs, its size and spacing thus depends upon the pipe size and type, and the conditions under which it will be used.

Figure 2:
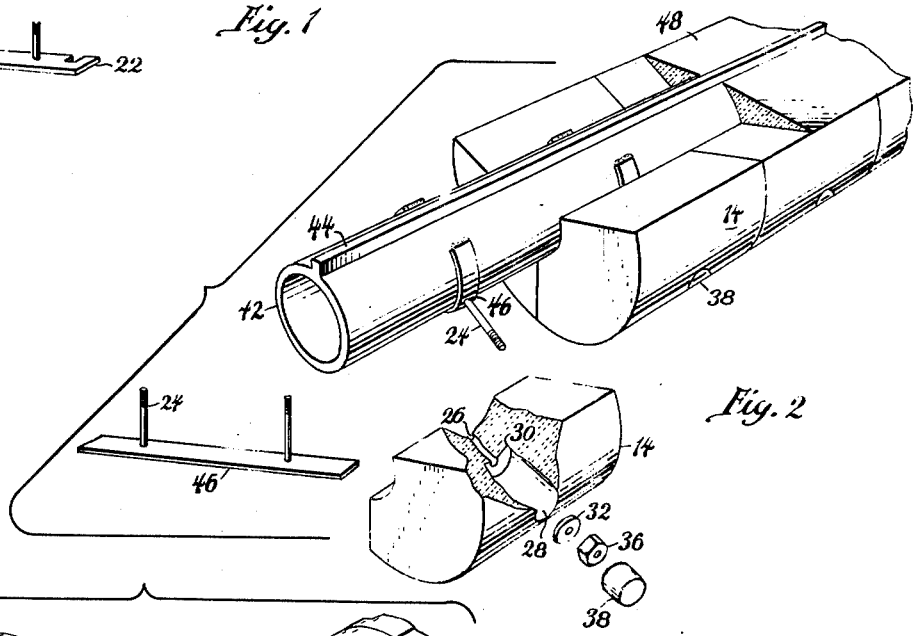
FIG. 2 is a perspective view of a "skid-pipe" having pre-cast segments of insulative material on the bottom thereof, while an upper segment is adapted to receive a molded section of plastic insulation.

On longitudinal skid pipes 42 of the type shown in FIG. 2 of the drawing, a skid rail 44 is welded to the top surface of a circular skid pipe 42 and a series of spaced bands 46 are welded at their ends to the outer surface of the pipe 42 to form a holding means around the outer surface thereof in accordance with FIG. 2 of the drawing. Here the bands 46 are welded to the pipe on opposite sides of the strap 44 to provide a smooth base for a quantity of plastic mortar 48 that is applied thereto so that the insulative jacket around the skid pipe is completed in a manner that does not interfere with moving a slab or the like down the skid rail.

Figure 3:
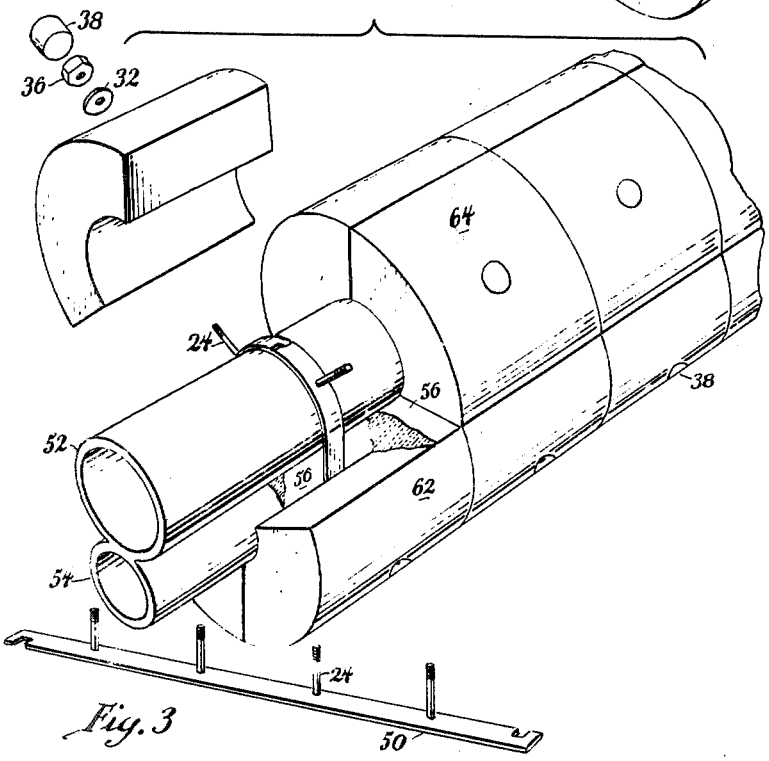
FIG. 3 is a perspective view of an adaptation modified to meet the requirements of a plural pipe arrangement.

The pipe jacket of this invention may readily be adapted to cover a variety of other pipe arrangements in the manner shown by FIG. 3 of the drawing. Here adjoining pipe sections 52 and 54 of different pipe sizes are enclosed in a continuous jacket. An elongate band 50 having a predetermined number of studs 24 attached thereto is first secured around abutting pipe sections to receive jacket segments 62 having an arcuate curvature that fits pipe 54. A ceramic packing 56 is spread on the edge of packing 62 and pre-cast segments 64 of the proper diameter are then positioned around the adjoining pipe segment 52 to complete the protective jacket. The tightening of nuts 36 and the insertion of insulation plugs 38 in the manner previously described will complete the assembly anchoring the insulative jackets to the pipe itself.

Other changes involving various ways in which studs 24 may be attached so that they may be longitudinally movable with respect to the bands 18, the manner by which the bands 18 are locked around the pipes, the shapes of the insulative segments or other adaptations and modifications may be made without the departing from the scope of the invention as defined by the following claims.

I claim:

1. An insulating jacket enclosing a water-cooled pipe, said jacket comprising arcuate segments of pre-cast insulating material formed to include an aperture extending radially therethrough, an elongate metallic band held concentrically adjacent said pipe, an elongate projection having the inner end thereof attached to said metallic band and the outer end thereof adapted to extend radially outward through an aperture in a segment of said jacket, and means clasping the outer end of said projection to anchor the arcuate segments of insulating material between ends thereof whereby said jacket is held firmly to said pipe.

2. An insulating jacket according to claim 1 in which the means holding the metallic band to the pipe comprises slotted ends thereof that interlock with one another to form a continuous band around the pipe.

3. An insulating jacket according to claim 1 in which the radially disposed aperture therein is at the approximate center of each section.

4. An insulating jacket according to claim 1 in which each radially disposed opening is partially counterbored to a larger diameter to produce a shoulder on each insulating segment, and means seated upon said shoulder adapted to draw the segment of insulative material closely adjacent the pipe section.

5. An insulating jacket according to claim 4 including a plug of insulative material adapted to fill the counterbored section of each radially disposed opening to preclude the flow of heat therethrough.

6. An insulating jacket for a water cooled pipe as defined in claim 1 including a skid rail bonded longitudinally to the upper surface of said pipe, said metallic band having opposite ends thereof fixed to said pipe adjacent sides of the longitudinal skid rail thereby holding said band around the pipe independent from the longitudinal skid.

7. An insulating jacket for a water cooled pipe as defined in claim 6 wherein the radial projection are slidably attached and longitudinally moveable along the elongate metallic band to permit independent alignment thereof with a radial aperture through the insulation jacket.

* * * * *